US006260454B1

(12) United States Patent
Laprade

(10) Patent No.: US 6,260,454 B1
(45) Date of Patent: Jul. 17, 2001

(54) WHEEL ALIGNMENT TOOL

(76) Inventor: Paul Kevin Laprade, 446 Hill Street, Unit 1, London, Ontario (CA), N6B 1E6

( * ) Notice: Subject to any disclaimer, the term of this patent is extended or adjusted under 35 U.S.C. 154(b) by 0 days.

(21) Appl. No.: 09/450,018

(22) Filed: Nov. 29, 1999

(51) Int. Cl.[7] ..... B25B 11/00
(52) U.S. Cl. ..... 81/484; 72/409.1
(58) Field of Search ..... 81/484; 72/409.1, 72/476

(56) References Cited

U.S. PATENT DOCUMENTS

| | | | |
|---|---|---|---|
| 3,731,906 | | 5/1973 | Beach . |
| 3,866,938 | | 2/1975 | Boyd . |
| 3,915,431 | * | 10/1975 | Castoe . |
| 4,144,652 | | 3/1979 | Romak . |
| 4,420,170 | | 12/1983 | Wysocki . |
| 4,424,697 | | 1/1984 | Carver . |
| 4,480,389 | | 11/1984 | Capoville . |
| 4,517,862 | | 5/1985 | Garcia . |
| 4,541,162 | | 9/1985 | Halvin . |
| 4,577,534 | * | 3/1986 | Rayne . |
| 5,020,231 | | 6/1991 | Huynh . |
| 5,033,179 | | 7/1991 | Specktor . |
| 5,111,586 | | 5/1992 | Huynh . |
| 5,285,704 | * | 2/1994 | Santana Gonzalez . |
| 5,339,508 | | 8/1994 | Ray . |
| 5,471,754 | | 12/1995 | Mieling . |
| 5,894,769 | * | 4/1999 | Rogers et al. . |
| 5,927,133 | | 7/1999 | Taylor . |

* cited by examiner

*Primary Examiner*—Timothy V. Eley
*Assistant Examiner*—Willie Berry, Jr.

(57) ABSTRACT

A method for adjusting the camber of a vehicle wheel having an axis of rotation and having camber adjustment means comprising the steps of loosening the wheel camber adjustment means while the wheel bears part of the motor vehicle's sprung mass, applying a clamp tool substantially vertically to the wheel whereby the tool straddles the wheel perpendicular to the axis of rotation, pivoting the tool and the wheel attached thereto perpendicular to the axis of rotation to a desired camber, and tightening said camber adjustment means. The clamp tool comprises a clamp having opposed inner and outer arms for engaging the respective inner and outer sidewalls of the wheel, at least one of the inner and outer clamp arms being extensible for engaging a wheel sidewall, means for adjusting the tool for snug engagement of the inner and outer arms with the wheel sidewalls, and lever means detachably connected to the tool for pivoting the tool and the wheel engaged by the tool.

3 Claims, 5 Drawing Sheets

WHEEL ALIGNMENT TOOL

FIELD OF THE INVENTION

This invention relates to the field of vehicle wheel camber adjustment and to tools and methods for accomplishing the same.

BACKGROUND OF THE INVENTION

A strut type suspension of a motor vehicle which permits selection of vehicle wheel camber alignment typically can have adjustable connections between the lower end of the strut member and the wheel support knuckle, thereby permitting selection of wheel camber alignment. Other strut type suspensions can have various types of adjustable connections which permit selection of wheel camber alignment. In addition, other types of motor vehicle suspensions can have a variety of adjustable connections permitting adjustment of camber alignment.

Adjustment of vehicle wheel camber using conventional prior art methods is time-consuming, inconvenient, and inefficient. For example, one of the more commonly used methods described in the prior art requires hoisting of a motor vehicle by means of a hydraulic hoist, suspension of a wheel and loosening of the bolts required to be loosened for the camber adjustment, and adjustment of the wheel's camber alignment while the wheel is suspended, using an appropriately calibrated optical guide which determines extent of camber. The optical guide needs to be calibrated when it is used in connection with a motor vehicle which has been raised on a hoist and the wheels are suspended in order to take into account the tendency of the wheels to splay outwards when they are so suspended.

In another example, in a vehicle suspension in which camber adjustment is effected by adjustment of a cam, the spring mass of the motor vehicle must be raised off a wheel before its camber can be adjusted. This is so because the cam cannot, as practical matter, be turned until the vehicle's spring mass has been taken off the wheel. In accordance with the prior art, the motor vehicle must be raised by means of a hydraulic hoist such that the wheel to be aligned does not bear any part of the motor vehicle's spring mass, thereby permitting the cam to be turned for amber alignment.

Many of the more commonly-used methods in the prior art require that the motor vehicle be raised by means of a hydraulic hoist so that no part of the motor vehicle's spring mass rests on the wheel for which camber is to be adjusted. Many such methods involve the use of eccentrics, hydraulic hoists or jacks, in conjunction with an appropriately calibrated optical guide, while the motor vehicle is raised and its wheels are suspended, so that adjustments to camber alignment are sometimes difficult to make and time-consuming.

SUMMARY OF THE INVENTION

It is an object of the present invention to provide a wheel alignment tool which obviates or mitigates at least one of the disadvantages of the prior art.

In a first aspect of the present invention, there is provided a wheel alignment tool for engaging a vehicle wheel having opposite inner and outer sidewalls comprising a clamp having opposed inner and outer arms for engaging the respective inner and outer sidewalls of the wheel, at least one of the inner and outer clamp arms being extensible for engaging a wheel sidewall in a pair of spaced-apart locations, means for adjusting the tool for snug engagement of the inner and outer arms with the wheel sidewalls, and lever means detachably connected to the tool for pivoting the tool and the wheel engaged by the tool. The means for adjusting the tool for snug adjustment of the inner and outer arms with the wheel sidewalls preferably comprises an intermediary angle member connecting the inner and outer arms, and bolt means adapted to slide in a slot formed in one of the inner arm or the intermediary angle member for securing the inner arm to the intermediary angle member. One of said outer clamp arm and said intermediary angle member has a slot formed therein for slidably receiving bolt means for extension and retraction of the said outer clamp arm relative to the intermediary angle member. The method of the invention for adjusting the camber of a vehicle wheel having an axis of rotation and having camber adjustment means perpendicular to the axis of rotation comprises the steps of: loosening the wheel camber adjustment means while the wheel bears part of the motor vehicle's sprung mass, applying a clamp tool substantially vertically to the wheel whereby the tool straddles the wheel perpendicular to said axis of rotation, pivoting the tool and the wheel attached thereto perpendicular to said axis of rotation to a desired camber, and tightening said camber adjustment means.

More particularly, the wheel alignment tool for adjustment of the camber setting of a motor vehicle wheel where said motor vehicle wheel is held in place by a strut suspension including a shock absorber, a clamp attached thereto, a knuckle held by said clamp the knuckle having a spindle, the motor vehicle wheel being mounted on the spindle and a means for loosening said clamp such that said knuckle can be rotated about said means, comprises a top clamp member having therein a top longitudinal slot and a downwardly depending inner arm having a spacer rod at the distal end thereof; an outside clamp member defining an outer arm having a spacer rod at the distal end thereof and a longitudinal slot; an inside intermediary angle member having a pair of threaded holes formed therein for receiving threaded bolts in the said longitudinal slots in the top clamp member and the outside clamp member for adjusting the alignment tool on the wheel and a wrench receiving means attached to the intermediary angle member such that a mating end of a wrench can be received within said wrench receiving means in a friction fit.

BRIEF DESCRIPTION OF THE DRAWINGS

A preferred embodiment of the invention will now be described, by way of example only, with reference to the attached drawings, in which.

DETAILED DESCRIPTION OF PREFERRED EMBODIMENT

Figure 1:
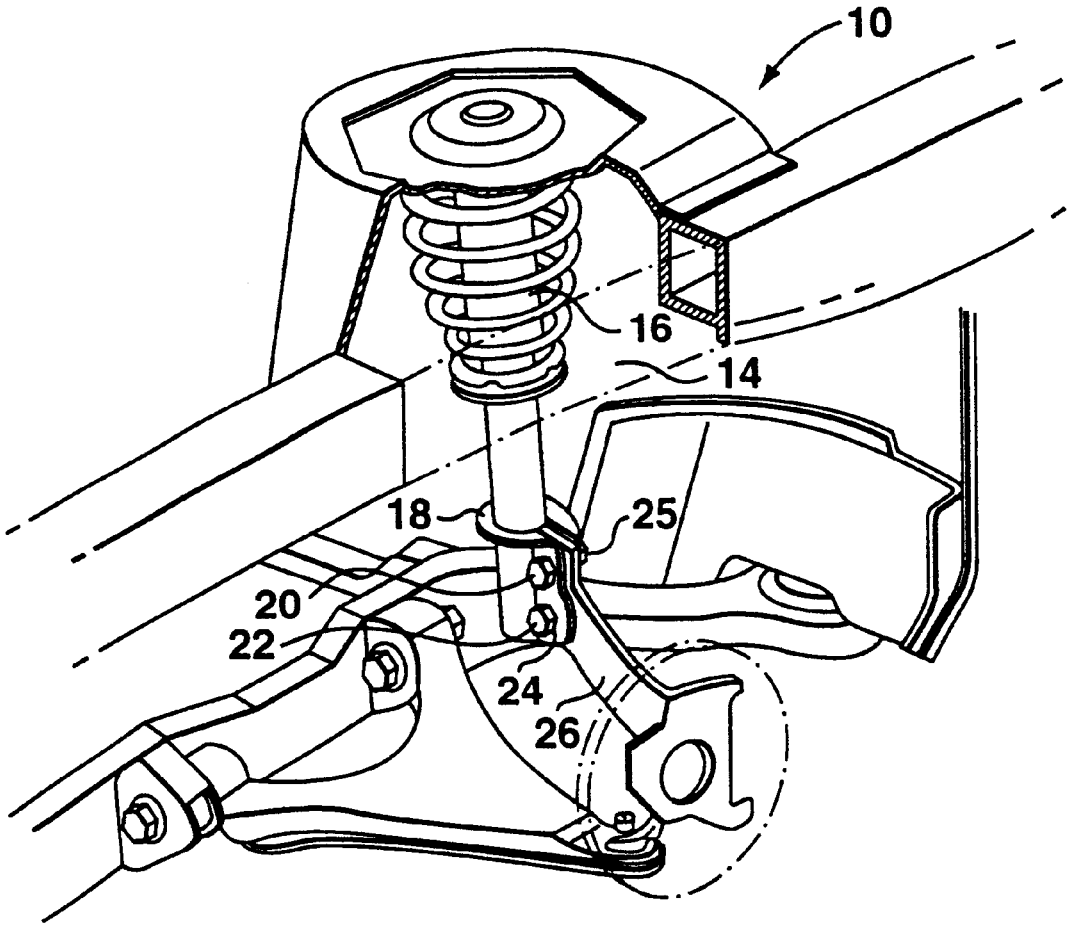
FIG. 1 (PRIOR ART)
FIG. 1 is a fragmentary perspective view of a motor vehicle strut type suspension with certain parts partially in phantom.

With reference to the drawings, FIG. 1 shows a motor vehicle 10 having a conventional strut suspension well known in the prior art and described generally as 14 at the motor vehicle's left front wheel. A strut type suspension can be applicable to front and rear wheels. The strut suspension includes a shock absorber 16. A clamp 18 is attached to the base of the shock absorber 16, which clamp is held in place by through-bolts 20 and 22. Through-bolts 22 is inserted into an overlarge hole 24. Nuts 25 are threaded upon the through-bolts 20 and 22.

A knuckle 26 is also held in place by the clamp 18. The knuckle 26 as shown in FIG. 1, for example, can receive caliper type disc brakes, and a motor vehicle wheel (not shown) can be mounted on a wheel spindle depicted by phantom lines 27 which is rotatably supported by the knuckle 26.

The hole 24 in which through-bolt 22 is inserted is overlarge so that adjustment to camber is thereby permitted, by pivoting of the knuckle 26 about an axis of rotation at through-bolt 20 upon loosening of through-bolt 22.

It should be apparent that different versions of strut suspensions can have somewhat different means for permitting adjustment to camber. The strut suspension shown in FIG. 1 is exemplary of conventional strut assemblies and is shown for illustrative purposes only.

In addition to strut suspensions, other types of suspensions are commonly used in motor vehicles. One common type, in particular, permits adjustment to a wheel's camber alignment by means of a cam.

Figure 2:
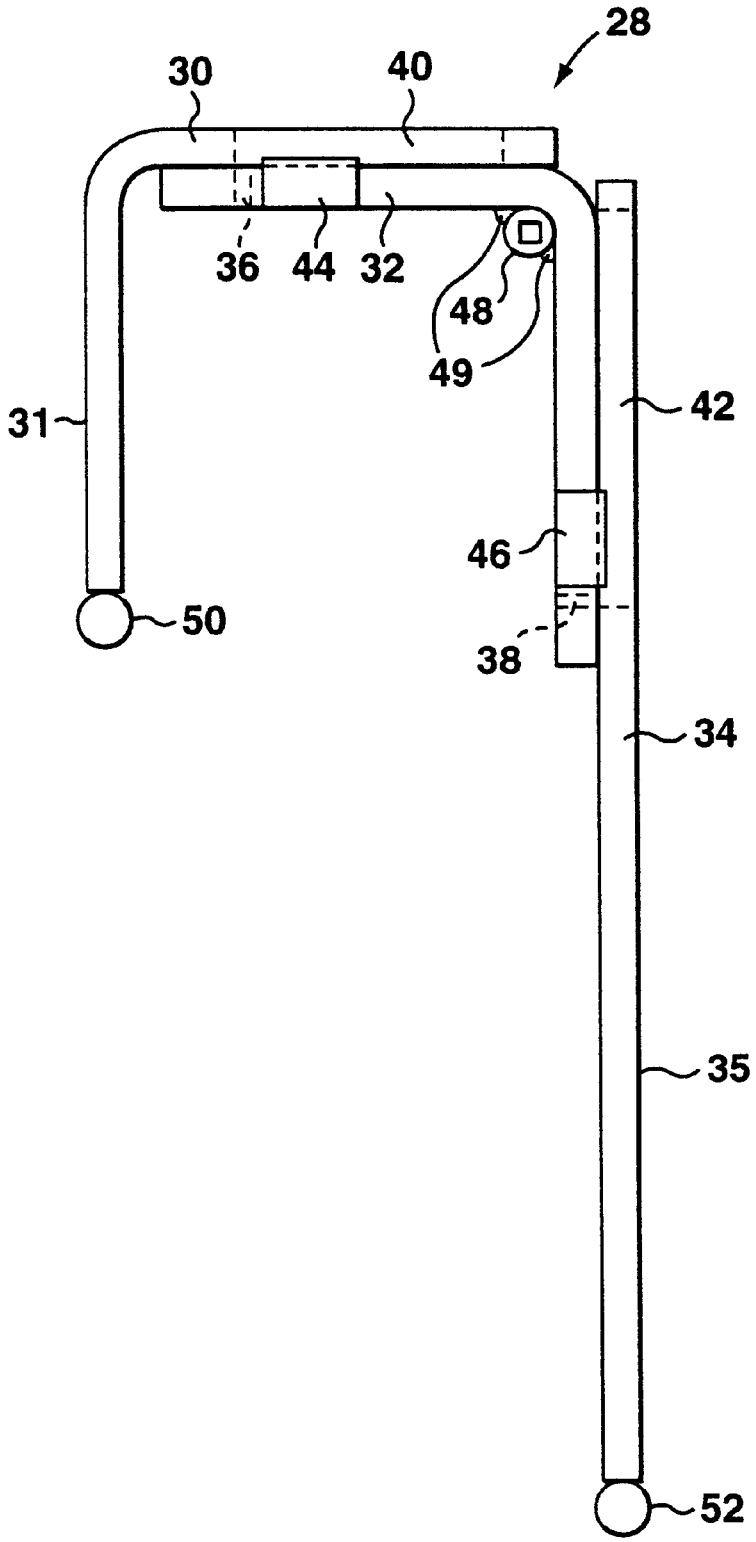
FIG. 2 is a side elevation view of the alignment of the present invention.

Referring to FIG. 2, the embodiment of wheel alignment tool 28 of the invention includes three main components, namely, a top clamp member 30, an inside intermediary angle member 32, and an outside clamp member 34.

The inside intermediary angle member 32 has two threaded holes 36 and 38 formed in it. The two threaded holes are for receiving bolts (shown in FIGS. 2,3 and 4), further described below, which are inserted into the threaded holes 36 and 38 through a top member slot 40 and an outside member slot 42. The top clamp member 30 can be moved relative to the inside intermediary angle member 32, as described further below. The top portion side guides 44 assist in keeping the top clamp member 30 aligned with the inside intermediary angle member 32 when the relative longitudinal movement of top clamp member 30 and inside intermediary angle member 32 takes place. Top clamp member 30 has a downwardly extending inner arm 31, to be described.

The outside clamp member 34 can be moved relative to the inside intermediary angle member 32, also as described further below. The outside portion side guides 46 assist in keeping the outside clamp member 34 aligned with the inside intermediary angle member 32 when longitudinal movement of the outside clamp member 34 relative to the inside intermediary angle member 32 takes place. Outside clamp member 34 defines extensible outer arm 35.

Fastened to the bight of the inside intermediary angle member 32 is a wrench receiving socket means 48 secured thereto such as by a weld 49. Spacer rod 50 and spacer rod 52 are located at the distal ends of the inner arm 3l and the outer arm 35 respectively.

Figure 3:
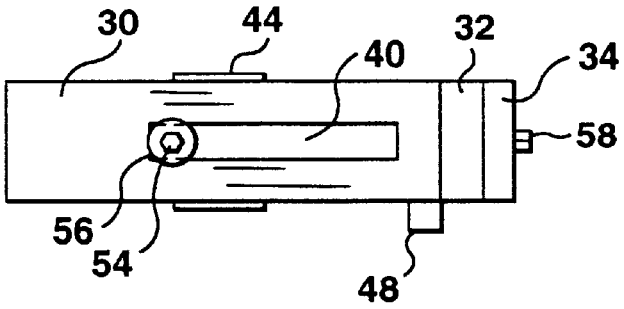
FIG. 3 is a top plan view of the present invention.

Referring to FIG. 3, a top bolt 54 is inserted through a washer 56 and through top member slot 40 and into threaded hole 36 formed inside intermediary angle member 32, into which the top bolt 54 is threadably received.

Figure 4:
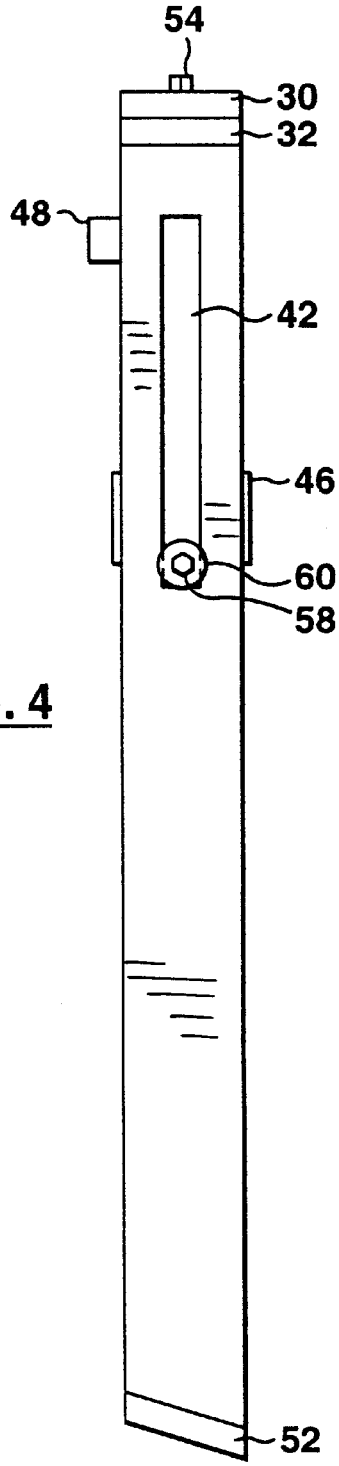
FIG. 4 is an end elevation view of the present invention.

Referring to FIG. 4, an outside bolt 58 is inserted through a washer 60 and the outside member slot 42 and into the threaded hole 38, into which the outside bolt 58 is threadably received.

Figure 5:
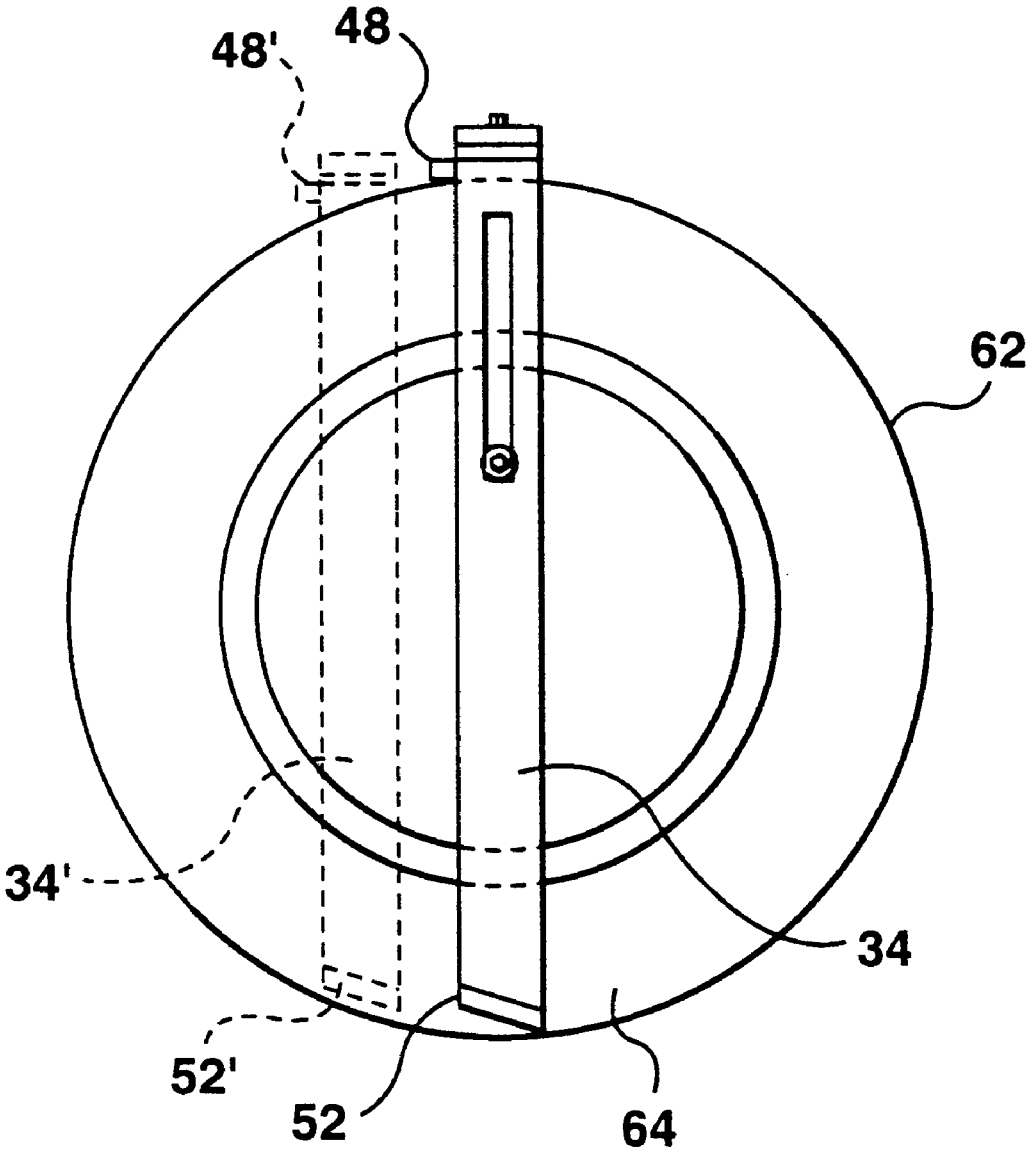
FIG. 5 is a side elevation view of a vehicle wheel with the alignment tool installed thereon.
Figure 6:
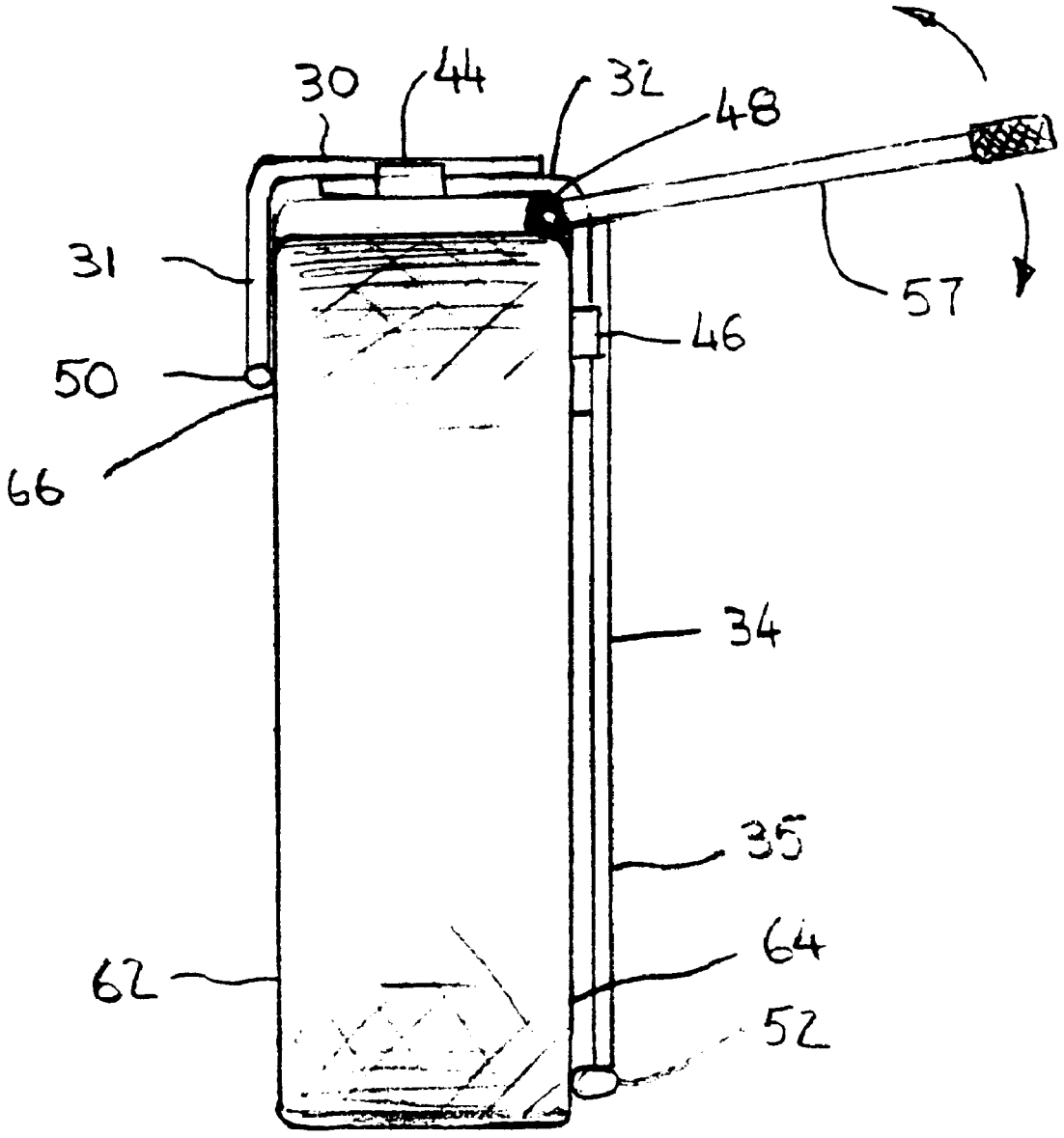
FIG. 6 is an end elevation view of a vehicle wheel with the alignment tool installed thereon.

A side elevation view of a typical vehicle wheel 62 is shown in FIG. 5, with the wheel alignment tool 28 installed thereon and an end elevation view of the vehicle wheel 62 with the alignment tool 28 installed thereon is shown in FIG. 6. To install the wheel alignment tool 28 on the vehicle wheel 62, the top bolt 54 is loosened so that the top clamp member 30 can move relative to the inside intermediary angle member 32, such movement of the top clamp member 30 being guided by the side guides 44 and limited by the ends of the slot 40. Because movement of the top clamp member 30 relative to the inside intermediary angle member 32 is possible, the top clamp member 30 of the wheel alignment tool 28 can be adjusted to fit the width of the vehicle wheel 62, such that the inner arm space rod 50 can engage the top inside sidewall 66 of vehicle wheel 62, and the bolt 54 tightened.

Depending on the configuration of the wheel well in the motor vehicle's body in which the vehicle wheel 62 is located, it is usually expedient to fit the wheel alignment tool 28 over the vehicle wheel 62 with the outer arm 35 at approximately a right angle to the vertical. After the top clamp member 30 has been adjusted so that the wheel alignment tool 28 can fit over the width of the vehicle wheel 62 and the inner arm rod 50 can engage the top inside sidewall 66, the alignment tool 28 is moved up the vehicle wheel 62 by rotating the wheel alignment tool 28 until the outer clamp arm 35 is approximately vertical and the top clamp member 30 is substantially horizontal.

A mounting device required in conjunction with an optical guide (not shown), which is used to determine the extent of camber adjustment required, can be attached to the hub of the vehicle wheel 62 on its outside, centred at the axis of rotation of the vehicle wheel 62. Because of the present of this device, the wheel alignment tool 28 often is most conveniently installed on the vehicle wheel 62 such that it is laterally offset from the vehicle wheel's axis of rotation, such as shown by phantom lines in FIG. 5 depicted by numerals 34', 48' and 52'. When the wheel alignment tool 28 is so located, the top clamp member 30 is adjusted relative to the inside intermediary angle member 32 so that it fits snugly onto the vehicle wheel 62 in a friction fit, and the top bolt 54 is tightened. For optimum results, it is important that the wheel alignment tool 28 be held on the vehicle wheel 62 tightly in a friction fit, as described. The inner arm 31 spacer rod 50 then engages the top inside sidewall 66 of the vehicle wheel 62.

After the top clamp member 30 has been adjusted to the width of the vehicle wheel 62 as described above, the outside clamp member 34 is adjusted relative to the inside intermediary angle portion 32 to allow for the height of the vehicle wheel 62. This adjustment is made by moving the outside clamp member 34 longitudinally relative to the inside intermediary angle member 32, with the outside bolt 56 loosened, the movement of the outside clamp member 34 being guided by the outside side guides 46. Once the outer arm 52 is located in the outside lower sidewall area 64 on the vehicle wheel 62, the bolt 56 is tightened.

After the wheel alignment tool 28 has been securely attached to the vehicle wheel 62 as described, lever means 57, such as a ratchet wrench, bar wrench or similar device, can be inserted into the wrench receiving socket means 48. By exertion of force up or down onto the wrench or similar device, the plane of the vehicle wheel 62 can be caused to be moved about an axis of rotation which is congruent with the centre line of through-bolt 20. The person exerting force on the wrench 57 up or down (as the case may be), can observe the results of such exertion of force by means of one of the several optical guides available, which optical guides are well known in the prior art, to assess how much further adjustment of camber is required. The person exerting the force on the vehicle wheel 62 in this way, via the wheel alignment tool 28 and wrench 57, has much more direct control of the adjustment of the camber than is the case where the prior art is utilized.

The adjustment to the camber is effected while the sprung mass of the motor vehicle 10 rests upon the motor vehicle's wheels, so that, after the camber adjustment has been made, the vehicle wheel 62 will not move. For example, where the motor vehicle's suspension is a strut suspension of the type shown in FIG. 1, there is then an opportunity to tighten through-bolts 20 and 22, thereby to hold vehicle wheel 62 in place, with its camber adjusted. While the through-bolts 20 and 22 are being tightened, the optical guide can be checked to ensure that the camber of the vehicle wheel 62 will remain satisfactory. Once the through-bolts 20 and 22 have been tightened and the optical guide has been checked to ensure that the camber adjustment remains satisfactory, the lever means 57 can be removed from the wrench receiving socket means 48, and the wheel alignment tool 28 can be removed from the vehicle wheel 62.

To remove the wheel alignment tool 28 from the vehicle wheel 62, the top bolt 54 is loosed, thereby permitting the movement of the top clamp member 30 relative to the inside intermediary angle member 32 so that the wheel alignment tool 28 is no longer firmly gripping the vehicle wheel 62, and the wheel alignment tool 28 can be removed from the vehicle wheel 62.

By way of another example, where a motor vehicle's suspension is not a strut suspension but rather of the type which permits adjustment of camber by means of a cam, the wheel alignment tool 28 can be used as an aid in the adjustment of camber as follows. After the wheel alignment tool 28 has been installed on a wheel 62 in the manner described above, a lever is inserted into the wrench receiving socket means 48. In these circumstances, the adjustment to camber is not effected directly by the application of force to the leverage means. Instead, when force is directed downward on the leverage means, the top of the wheel 62 is moved outward from the motor vehicle, and the pressure on the camber adjustment cam is thereby relieved. This permits the camber adjustment cam to be turned, so that camber is thereby adjusted.

It will be apparent that, while presently preferred embodiments of the present invention are described herein, variations and modifications will occur to those skilled in the art and should not be considered as departing from the spirit of the invention.

I claim:

1. A wheel alignment tool for engaging a vehicle wheel having opposite inner and outer sidewalls comprising a clamp having opposed inner and outer arms for engaging the respective inner and outer sidewalls of the wheel, at least one of the inner and outer clamp arms being extensible for engaging a wheel sidewall in a pair of spaced-apart locations, an intermediary angle member connecting the inner and outer arms, and bolt means adapted to slide in a slot formed in one of the inner arm or the intermediary angle member for securing the inner arm to the intermediary angle member for adjusting the tool for snug engagement of the inner and outer arms with the wheel sidewalls, and lever means detachably connected to the tool for pivoting the tool and the wheel engaged by the tool.

2. A wheel alignment tool as claimed in claim 1 in which one of said outer clamp arm and said intermediary angle member has a slot formed therein for slidably receiving bolt means for extension and retraction of said outer clamp arm relative to the intermediary angle member.

3. A wheel alignment tool for adjustment of the camber setting of a motor vehicle wheel where said motor vehicle wheel is held in place by a strut suspension including a shock absorber, a clamp attached thereto, a knuckle held by said clamp, said knuckle having a spindle, the motor vehicle wheel being mounted on the spindle, and a means for loosening said clamp such that said knuckle can be rotated about said means, comprising a top clamp member having therein a top longitudinal slot and a downwardly depending inner arm having a spacer rod at the distal end thereof; an outside clamp member defining an outer arm having a spacer rod at the distal end thereof and a longitudinal slot; an inside intermediary angle member having a pair of threaded holes formed therein for receiving threaded bolts in said longitudinal slots in the top clamp member and the outside clamp member for adjusting the alignment tool on the wheel and a wrench receiving means attached to the intermediary angle member such that a mating end of a wrench can be received within said wrench receiving means in a friction fit.

* * * * *